United States Patent [19]

Valenti et al.

[11] Patent Number: 4,573,239

[45] Date of Patent: Mar. 4, 1986

[54] THREE KNUCKLE HINGE WITH BUSHING INSERTS IN CENTER KNUCKLE AND METHOD OF MAKING SAME

[75] Inventors: Richard L. Valenti, New Britain; Daniel J. McCormick, Cheshire, both of Conn.

[73] Assignee: The Stanley Works, New Britain, Conn.

[21] Appl. No.: 642,033

[22] Filed: Aug. 17, 1984

[51] Int. Cl.[4] ..... E05D 11/00

[52] U.S. Cl. ..... 16/273; 16/380; 16/386; 16/DIG. 42; 16/DIG. 27; 29/11

[58] Field of Search ..... 16/273, 342, 380, 381, 16/386, DIG. 27, DIG. 42; 29/11

[56] References Cited

U.S. PATENT DOCUMENTS

| | | | |
|---|---|---|---|
| 84,771 | 12/1868 | Shannon | 16/386 |
| 112,978 | 3/1871 | St. John | 16/273 |
| 179,470 | 7/1876 | Buffington . | |
| 365,552 | 6/1887 | Taylor . | |
| 504,877 | 9/1893 | Hart . | |
| 513,042 | 1/1894 | Gridley . | |
| 799,275 | 9/1905 | Stevens | 16/381 |
| 1,076,689 | 10/1913 | McKinney . | |
| 1,909,990 | 5/1933 | Weller . | |
| 2,750,620 | 6/1956 | Clarke . | |
| 3,725,973 | 4/1973 | Gwozdz . | |
| 3,921,225 | 11/1975 | Suska . | |
| 3,991,436 | 11/1976 | Nagase . | |
| 4,135,273 | 1/1979 | Holmes | 16/381 |
| 4,329,758 | 5/1982 | Föhl . | |

FOREIGN PATENT DOCUMENTS

| | | | |
|---|---|---|---|
| 19097 | 2/1905 | Austria | 16/386 |
| 172151 | 6/1906 | Fed. Rep. of Germany . | |
| 4631 | of 1898 | United Kingdom . | |

*Primary Examiner*—Fred Silverberg

[57] ABSTRACT

A hinge has a pair of leaves, one of which has a spaced pair of knuckles and the other has a central knuckle disposed therebetween. Disposed in the single knuckle are a pair of tubular bushing inserts received in opposite ends of its passage and having radial flanges disposed between the adjacent knuckles. The two knuckle hinge leaf is engaged with a pair of hinge pin elements extending inwardly from the opposite end of the leaf so as to prevent relative rotation therebetween, while the hinge pin elements extend into and are freely rotatable in the inserts. In the method of assembly, the bearing inserts are placed in the single knuckle leaf, and the two knuckle leaf is then aligned therewith and the hinge pin elements are inserted and engaged with the two knuckle leaf to prevent relative rotation therebetween.

10 Claims, 11 Drawing Figures

THREE KNUCKLE HINGE WITH BUSHING INSERTS IN CENTER KNUCKLE AND METHOD OF MAKING SAME

BACKGROUND OF THE INVENTION

The present invention relates to hinges, and, more particularly, to hinges provided with bushings to eliminate metal-to-metal contact between the hinge leaves and to methods for assembling such hinges.

The cooperating leaves of lower cost hinges such as strap and T-hinges are generally formed by metal stamping equipment from heavy gauge steel sheet. These leaves have an attachment portion for securing the hinge to the door or gate and to the associated door or gate frame, and one or more prongs or knuckles thereon which have aligned apertures therethrough and which define a barrel in which is seated a hinge pin or pins.

Metal-to-metal contact between adjacent knuckles during pivoting will produce wear of the parts, especially when the hinge is used to suspend a heavy door or the like. Moreover, the rotation of the pin within the knuckles will also produce wear which is accelerated by dirt and corrosion.

In U.S. Pat. Nos. 3,725,973 and 3,921,225,the hinges have plastic bearings between the knuckles to retard the wear. Other hinges use ball bearings; still others use bushings with axially extending portions and thrust washers. The forming and/or assembly operations required for most of these hinges increase the cost substantially.

It is an object of the present invention to provide a novel and economical hinge which can be readily fabricated and which exhibits relatively long life.

It is also an object to provide such a hinge having a pair of bushings which may be readily assembled to the knuckle of a single knuckle hinge leaf to provide bearing surfaces for the hinge pin and between it and the knuckles of a cooperating two knuckle hinge leaf.

Still another object is to provide relatively simple and low cost methods for making such hinges.

SUMMARY OF THE INVENTION

It has now been found that the foregoing and related objects and advantages may be readily attained in a hinge comprising a first leaf including an attachment portion and a knuckle portion centrally located on one edge of said attachment portion, and having a passage extending axially therethrough. A pair of bearing inserts are located at the opposite ends of the knuckle portion and extend into its axial passage, and each of the inserts has a tubular body portion of generally circular cross section. A radially outwardly extending flange portion at one end of the inserts abuts the adjacent end of the knuckle portion, and the tubular body portion is engaged within the knuckle portion to inhibit relative rotation. A second hinge leaf includes an attachment portion and a pair of spaced apart knuckle portions along one edge between which the knuckle portion of the first leaf is disposed, and the flange portions of the inserts abut the inner end of its knuckle portions. The knuckle portions of the second hinge leaf have an axially extending passage therein which is coaxial with the passage of the first leaf knuckle portion. Extending through the passages of the knuckle portions of the first and second leaves and in the inserts, is hinge pin means which is engaged with the knuckle portions of the second leaf to prevent relative movement therebetween. However, it is freely rotatable in the bearing inserts to provide a pivotal connection between the first and second hinge leaves.

In One embodiment, the hinge pin means comprises two pin elements extending into the passages defined in the knuckle portions from opposite ends of the second leaf. Each of the pin elements may have an end cap disposed outwardly of the cooperating knuckle portion.

Desirably, each of the knuckle portions of the second leaf has a projection on the inner surface thereof which engages the hinge pin means to provide mechanical engagement therebetween to prevent relative movement. The body portions of the bearing inserts have ribs on the outer surfaces thereof providing frictional engagement with the knuckle portion of the one leaf, and also have ribs on the inner surface thereof spaced along their inner wall intermediate the ribs on the outer surface which provide resilient bearing surfaces for the hinge pin means.

The hinge is desirably assembled by a method in which there is provided a first hinge leaf including an attachment portion and a knuckle portion centrally located on its one edge and having a passage extending axially therethrough. Inserted into the opposite ends of the knuckle portion is a pair of bearing inserts each having a tubular body portion seating in the passage of the knuckle portion and a radially outwardly extending flange portion abutting the ends of the kunckle portion. These bearing inserts are engaged with the knuckle portion to inhibit relative rotation therebetween.

To the first hinge leaf is then assembled a second hinge leaf including an attachment portion and a pair of knuckle portions spaced apart along its one end which receive the knuckle portion of the first leaf therebetween. The flange portions of the inserts abut the inner ends of the second leaf knuckle portions of the second leaf, and these knuckle portions which also have an axially extending passage therein coaxial with the passage of the first hinge leaf. Hinge pin means is inserted into the passages of the knuckle portions of the first and second hinge leaves and the bearing inserts to pivotally connect the first and second leaves, and the hinge pin means is engaged with the knuckle portions of the second hinge leaf to prevent relative movement therebetween.

In one embodiment of the method, the two pin elements are inserted into the outer ends of the knuckle portions of the second leaf and thence into the inserts and knuckle portion of the first leaf. These pin elements may have end caps at one end thereof and are inserted into the passages of the knuckle portions until the end caps abut the ends of the knuckle portions of the second leaf.

Desirably, the inner surface of the knuckles of the second hinge leaf are provided with projections which engage the hinge pin means to effect mechanical engagement therebetween.

In one process, end caps are swaged on the hinge pin means to engage the pin means with the knuckle portions of the second hinge leaf. Preferably, the knuckle portions of the second hinge leaf may be swaged to interlock with the hinge pin means.

DETAILED DESCRIPTION OF THE ILLUSTRATED EMBODIMENT

Figure 1:
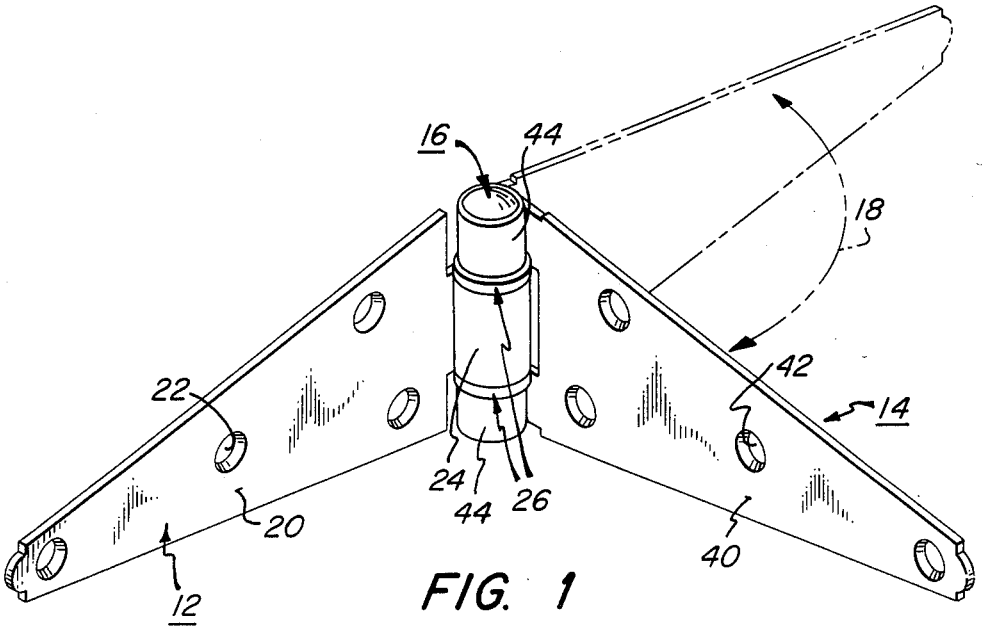
FIG. 1 is a perspective view of a strap hinge embodying the present invention with one of the hinge leaves illustrated in a first position in solid line and in a pivoted position in phantom line, in which the center knuckle is of larger diameter than the outer knuckles for use with a single element hinge pin.

Referring first to FIG. 1, therein illustrated is a strap hinge embodying the present invention which includes a pair of leaves generally designated by the numerals 12 and 14. The hinge pin generally designated by the numeral 16 allows relative pivotal movement between the leaves 12 and 14 as indicated by the double-headed arrow 18 and the solid and phantom line positions of the leaf 14 in FIG. 1.

The left hand or single prong hinge leaf 12 has a triangularly shaped attachment or strap portion 20 with a multiplicity of apertures 22 therein which are countersunk to receive the head of a flat head wood or sheet metal screw (not shown). Located at the wide end of the strap portion 20 is a centrally located knuckle portion 24 which provides an axial passage therein for receiving the hinge pin 16.

Figure 2:
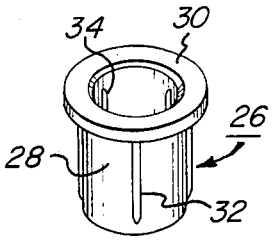
FIG. 2 is a perspective view of one of the bushings or inserts in the hinge of FIG. 1.
Figure 3:
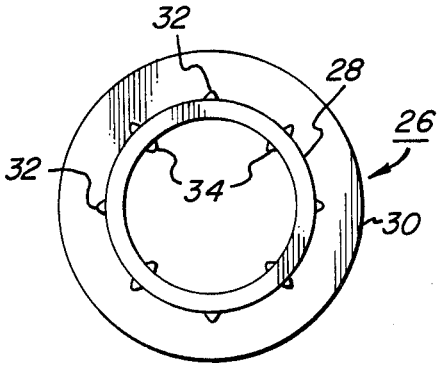
FIG. 3 is an enlarged bottom view of the bushing of FIG. 2.

Mounted at either end of the knuckle portion 24 and extending into the passage defined therein are a pair of generally cylindrical, tubular inserts or bushings generally designated by the numeral 26. As shown in FIGS. 2 and 3, each of the bushings 26 has a tubular body portion 28 of generally cylindrical and a radially outwardly extending flange or collar portion 30 at one end thereof. The tubular body portion 28 is provided with a multiplicity of axially extending external ribs 32 and internal ribs 34. The external ribs 32 are spaced about the outer surface of the tubular body portion 28, and the four internal ribs 34 are spaced 90 degrees from each other about the inner surface of the tubular body portion 28.

The passage in the knuckle portion 24 and the tubular body portions 28 with the external ribs 32 are cooperatively dimensioned so that the bushings 26 fit with a friction fit in the knuckle passage, thereby inhibiting relative movement between them and accommodating dimensional variations that may occur in the metal forming processes. The external diameter of the flange portion 30 of each bushing 26 is approximately equal to the external diameter of the knuckle portion 24 so that the flange portion 30 abuts the end of the knuckle portion 24 and is flush with its circumferential surface.

The two prong hinge leaf 14 also has a triangularly shaped attachment or strap portion 40 with apertures 42 therein and a pair of axially spaced knuckle portions 44 at one end thereof which provide an axial passage therein. The passages of the spaced knuckle portions 44 and the central knuckle portion 24 are axially aligned to permit passage of the hinge pin 16 therethrough. As illustrated in FIG. 1, the knuckle portions 44 are of lesser inner and outer diameters than the knuckle portion 24, as would be desirable when a single element hinge pin with a uniform diameter shank is used in the present invention in order to accommodate the thickness of the bushings 26 in the central knuckle portion 24.

Figure 4:
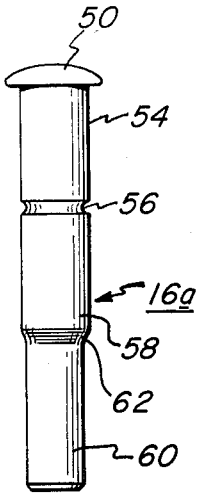
FIG. 4 is a side elevational view of one element of a two element hinge pin that is used in the preferred embodiment of the hinges of the present invention.
Figure 6:
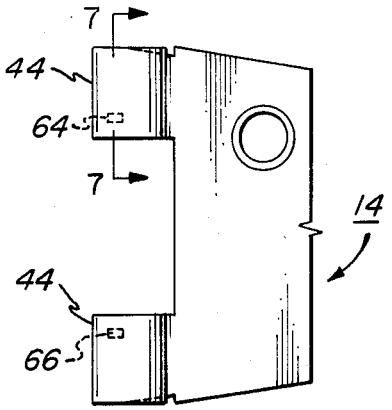
FIG. 6 is a fragmentary elevational view of a preferred embodiment of the two-knuckle hinge leaf with the hinge pin means disassembled therefrom.
Figure 7:
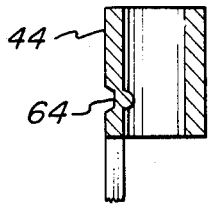
FIG. 7 is a fragmentary cross-sectional view of the hinge leaf of FIG. 6 taken along the line 7—7 thereof.

Referring now to FIG. 4, therein illustrated is one element 16*a* of the preferred two element hinge pin 16. In this construction, the two pin elements extend from either end of the spaced knuckle portions 44 into the central knuckle portion 24. It has a cap 50 at one end and a generally cylindrical shank comprised of a first portion 54 adjacent the cap 50, a circumferential groove 56 at its end, a second portion 58 of a diameter equal to that of the first portion, and a third portion 60 adjacent its other end with a reduced diameter providing a tapered shoulder 62 therebetween. The flange portions 30 of the inserts 26 are located below the tapered shoulder 62 when assembled, and the third portion 60 extends into the bushing 26. This permits the several knuckles to be of uniform diameter As seen in FIGS. 6 and 7, the spaced knuckle portions 44 of the hinge leaf 14 are staked to provide projections or ribs 64, 66 which extend into the groove 56 of the pin element 16*a* to prevent relative rotation and axial movement of the pin elements 16*a* therewithin. This staking is done upon assembly of the pin elements 16*a* within the assembled leaves 12, 14.

Figure 5:
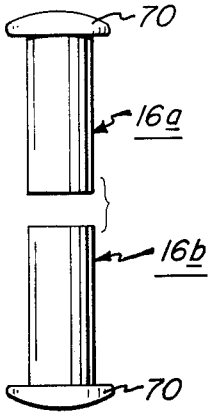
FIG. 5 is a side elevational view of another embodiment of a two element hinge pin that may be used in the hinge of FIG. 1.

In FIG. 5, the hinge pin elements are generally indicated by the numeral 16*a*, 16*b*, have an end cap 70 at one end thereof and have uniform diameter shank portions. After assembly, the knuckle portions 44 are staked at several points after assembly with the pin to deform metal into the hinge pin elements 16*a*, 16*b* to provide mechanical engagement within the knuckle portions 44. This may leave radial clearace between the pin elements 16*a*, 16*b* and the inside wall of the knuckle portions 44 if their diameter is uniform with that of the central knuckle portion 24. However, staking at several points may be used to ensure against relative movement and provide centering within the barrel.

Thus, with any of the several embodiments of hinge pin 16, there is ultimately an interference fit or mechanical interengagement between the hinge pin 16 (or its elements) and the spaced knuckle portions 44 so that there is no relative movement therebetween, either rotational or axial. The only relative movement in the assembled hinge is in the central knuckle portion 24 between the hinge leaf 12 and its inserts 30 and the hinge pin 16 (or its elements).

The internal ribs 34 on the bushings 26 accommodate the tolerances necessary in the manufacturing operation and are deflectable to center the pin 16 within the passage.

Figure 8:
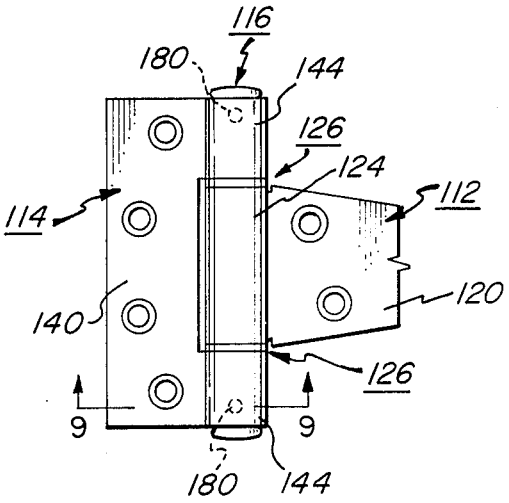
FIG. 8 is a fragmentary side elevational view of a T-hinge embodying the present invention.
Figure 9:
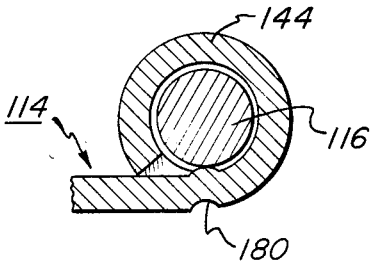
FIG. 9 is a fragmentary cross-sectional view taken along the line 9—9 of FIG. 8.

In FIG. 8, there is illustrated a T-hinge having leaves generally designated 112, 114 with attachment portions 120 and 140 and knuckle portions 124 and 144. The pin 116 is comprised of a pair of pin elements inserted into the knuckles 144 from either end of the leaf 114. The inserts 126 are again seated in the central knuckle 124. To prevent relative rotation and axial movement within the knuckles 144, the knuckle portions 144 are staked after assembly as seen at 180 to interengage with a circumferential groove in (and preferably indent) the pin 116.

Figure 10:
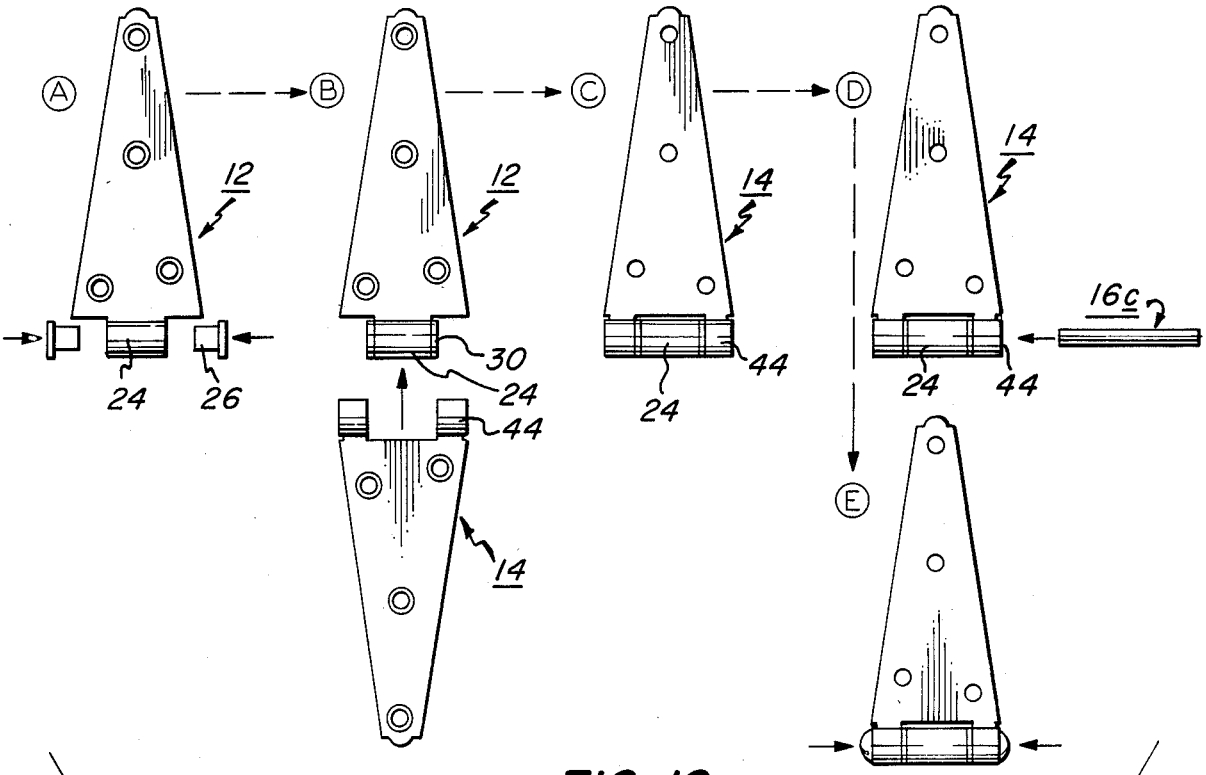
FIGS. 10 and 11 illustrate two different methods of assembly of hinges in accordance with the present invention, with the hinge leaves shown in the open condition in positions 3 and 4 of FIG. 11 for clarity of illustration.

One method for automated assembly of the hinges of the present invention is shown in the sequence of steps illustrated in FIG. 10 of the drawings. The assembly can take place on automated equipment whereby the single prong hinge leaves 12 with the centrally-located knuckle portion 24 are stacked and automatically fed into position A shown in FIG. 10. Bushings or inserts 26 are oriented into position on either ends of the central knuckle portion 24. Upon registration, solenoids or other actuators (not shown) push the bushings 26 into opposite ends of the central knuckle portion 24 as indicated by the arrows 90 in position A in FIG. 11.

The leaf 12 is then transferred to position B where the two prong leaf 14 with the spaced knuckle portions 44 is fed so that its knuckle portions 44 receive the central knuckle 24 and flange portions 30 of the inserts 26 therebetween with the passages of the knuckle portions 24, 44 coaxially aligned. The assembled leaves 12, 14 are closed as they are automatically transferred to position C and thence to position D where a length of wire stock 16C is cut from a coil (not shown) and driven into the passages formed in the knuckle portions 24 and 44.

In step E the projecting ends of the wire stock 16C are spun over the ends of the knuckle portions 44 to interlock it therewith, particularly since some of the metal will normally extend into the spacing between the end of the rolled over knuckle portion and the body of the leaf as well as into the barrel about the pin 16. Punches or similar tools may also swage the barrel portions 44 along their length into the pin 16. If so desired, the knuckle portions 44 may be of lesser diameter than the knuckle portion 24 to snugly seat the pin 16.

Figure 11:
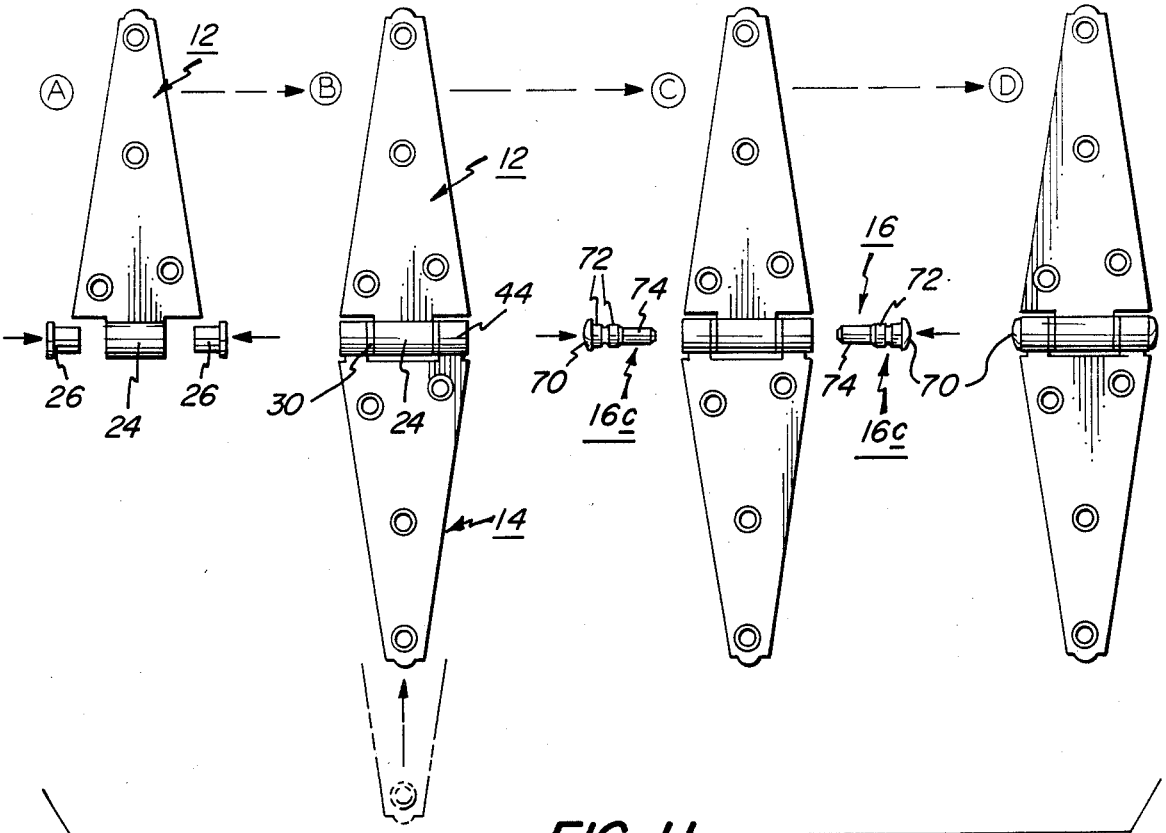

Illustrated in FIG. 11 is another method of assembly utilizing a two pin element embodiment of the hinge of the present invention and illustrated in FIG. 4. The hinge leaf 12 with the centrally located knuckle portion 24 is fed into position A and the bushings 26 are fed to positions at opposite ends of the central knuckle portion 24 coaxially aligned with the passage therein. Solenoids (not shown) then push the bushings 26 in the direction indicated by the arrows 90 to force fit the bushings 26 into the knuckle passage. The leaf 12 is then transferred to the position B and the leaf 14 with spaced knuckle portions 44 is fed into position with its passage coaxially with that of the leaf 12. The hinge leaves 12, 14 are automatically closed as they are being transferred to position C (although they are shown open for clarity of illustration). Fed into position are a pair of hinge pin elements 16*c* formed with caps 70, a large diameter portion 72 adjacent the caps 70 and a small diameter portion 74 at the inner end to seat in the bushings 26. The pin elements 16*c* are driven into the knuckle portions 24, 44 with the large portions 72 providing an interference fit in the knuckle portions 44 and the reduced portions 74 freely rotating in the bushings 26. Preferably, the method includes the staking of the knuckle portions 44 to engage in the grooves, as described with respect to FIGS. 4, 6 and 7.

Various other techniques for locking the hinge pin or its elements to the two-knuckle hinge leaf may be employed but staking, cap spinning and interference fitting have proven effective and economical as well as readily adaptable to automated equipment. Preformed hinge pins such as illustrated in FIGS. 5 and 11 are readily insertable and may desirably employ a staking operation after assembly to ensure freedom from relative movement.

The inserts can be molded from a thermoplastic material providing low friction and exhibiting long life such as acetal resin or high strength glass reinforced tetrafluoroethylene-filled nylon. Other resins which exhibit lubricity or durability, resilience and wear resistence may also be employed as may be bushings which are fabricated from metal such as oil-filled or resin filled metals.

Thus, it can be seen from the foregoing detailed specification and drawings that the hinges of the present invention provide an economical and simple hinge assembly which will afford relatively long life. The hinges may be assembled quickly and economically, and the methods of assembly may be readily practiced on automated equipment in a cost effective manner.

Having thus described the invention, what is claimed is:

1. A three knuckle hinge comprising:

(a) a first leaf including an attachment portion and an elongated knuckle portion centrally located on one edge of said attachment portion, said knuckle portion being axially continuous and one-piece and having a passage extending axially therethrough;

(b) a pair of bearing inserts located at the opposite ends of said knuckle portion and extending into said axial passage, each of said inserts being one-piece and integrally formed with a tubular body portion of generally circular cross section and a radially outwardly extending flange portion at one end of said tubular body portion abutting the adjacent end of said knuckle portion, said tubular body portion having ribs on the outer surface therein deformed to provide frictional engagement with said knuckle portion to inhibit relative rotation, wherein the body portions of said bearing inserts have ribs on the inner surface thereof spaced along the inner walls (c) a second leaf including an attachment portion and a pair of spaced apart knuckle portions along one edge of said attachment portion with said knuckle portion of said first leaf disposed therebetween and the adjacent surface of the flange portions of said inserts directly abutting said knuckle portions of said second leaf, said knuckle portions of said second hinge leaf having an axially extending passage therein coaxial with said passage of said knuckle portion of said first leaf; and (d) hinge pin means extending through said passages of said knuckle portions of said first and second leaves and in said inserts, said hinge pin means being engaged with said knuckle portions of said second leaf to prevent relative movement therebetween and being rotatable in said bearing inserts to provide a pivotal connection between said first and second leaves, said hinge pin means comprising two pin elements extending into said passages defined in said knuckle portions from opposite ends of said second leaf, said inner surface thereby providing the bearing surfaces for said hinge pin elements.

2. The hinge in accordance with claim 1 wherein each of said pin elements includes an end cap disposed outwardly of the cooperating knuckle portion.

3. The hinge in accordance with claim 1 wherein each of said knuckle portions of said second leaf have a projection on the inner surface thereof engaged with the hinge pin elements to provide mechanical engagement therebetween.

4. The hinge in accordance with claim 1 wherein said hinge pin elements have a circumferential groove therein and said knuckle portions of said second leaf each have a projection thereon extending and engaged in said groove of the adjacent hinge pin element.

5. In a method for assembling a three knuckle hinge, the steps comprising:

(a) providing a first hinge leaf including an attachment portion and an elongated knuckle portion centrally located on one edge of said attachment portion, said knuckle portion being one-piece and axially continuous and having a passage extending axially therethrough;

(b) inserting into the opposite ends of said kunckle a pair of one-piece bearing inserts integrally formed with a tubular body portion seating in said passage of said knuckle portion and a radially outwardly extending flange portion abutting the ends of said knuckle portion, said bearing inserts having ribs on the inner and outer surface thereof deforming said ribs to frictionally engage said knuckle portion to inhibit relative rotation;

(c) assembling to first hinge leaf a second hinge leaf including an attachment portion and a pair of knuckle portions spaced apart along one end of said attachment portion, said knuckle portion of said first leaf being disposed between said pair of knuckle portions of said second leaf, said flange portions of said inserts directly abutting the adjacent surfaces of the ends of said knuckle portions of said second leaf, said knuckle portions of said second hinge having an axially extending passage therein coaxial with said passage of said first hinge leaf; and (d) inserting a pair of hinge pin elements into the outer ends of said knuckle portions of said second leaf and thence into said inserts and into engagement with said inner ribs and knuckle portion of said first leaf to pivotally connect and first and second leaves, said hinge pin elements being engaged with said knuckle portions of said second hinge leaf to prevent relative rotation therebetween said inner ribs providing bearing surfaces for said hinge pin elements.

6. The method in accordance with claim 5 wherein said pin elements have end caps at one end thereof and are inserted into said passages of said knuckle portions until said end caps abut the ends of the knuckle portions of said second leaf.

7. The method in accordance with claim 5 wherein the inner surface of said knuckles of said second. hinge leaf are provided with projections, engaging said projections with hinge pin elements to effect mechanical engagement therebetween.

8. The method in accordance with claim 5 wherein there is included tthe step of swaging end caps on said hinge pin elements to engage said pin means with said knuckle portions of said second hinge leaf.

9. The method in accordance with claim 5 wherein there is including the step of swaging said knuckle portions of said second hinge leaf to interlock with said hinge pin elements. means.

10. The method in accordance with claim 5 wherein said hinge pin elements have a circumferential groove and said knuckle portions of said second hinge leaf are swaged to deform metal thereof into said groove.

* * * * *

UNITED STATES PATENT AND TRADEMARK OFFICE

CERTIFICATE OF CORRECTION

PATENT NO. : 4,573,239

DATED : March 4, 1986

INVENTOR(S) : Richard L. Valenti et al

It is certified that error appears in the above—identified patent and that said Letters Patent is hereby corrected as shown below:

Column 6, line 64, before "thereby" insert -- ribs --.

Column 8, line 8, after "connect" replace "and" with -- said --.

Column 8, line 23, before "hinge" insert -- said --.

Column 8, line 25, "tthe" should be -- the --.

Column 8, line 31, delete "means" after the period.

Signed and Sealed this

*First* Day of *July 1986*

[SEAL]

*Attest:*

DONALD J. QUIGG

*Attesting Officer*

*Commissioner of Patents and Trademarks*